United States Patent [19]

Ripka et al.

[11] Patent Number: 5,038,750

[45] Date of Patent: Aug. 13, 1991

[54] AIR HEATING APPARATUS

[75] Inventors: Chester D. Ripka; Norman Washburn, both of Syracuse, N.Y.

[73] Assignee: Carrier Corporation, Syracuse, N.Y.

[21] Appl. No.: 557,239

[22] Filed: Jul. 25, 1990

[51] Int. Cl.[5] ..... F24H 3/00

[52] U.S. Cl. ..... 126/99 A; 126/110 R; 126/116 R; 165/47 H; 165/104.14

[58] Field of Search ..... 126/116 A, 110 R, 99 R, 126/116 R, 117, 118, 99 A, 92 R, 99 C, 99 D, 92 C; 237/55, 53; 165/70, 104.11, 104.26, 47 H, 104.14

[56] References Cited

U.S. PATENT DOCUMENTS

| | | | |
|---|---|---|---|
| 4,177,858 | 12/1979 | Daman et al. | 165/70 |
| 4,275,705 | 6/1981 | Schaus | 126/110 R |
| 4,577,615 | 3/1986 | Tomlinson | 126/99 A |

*Primary Examiner*—James C. Yeung

[57] ABSTRACT

A space heating appliance employing a radiant burner that burns a gaseous fuel and a plurality of heat pipes to transfer heat produced by the burner to the air to be heated. The appliance is adaptable for use in outdoor "packaged" units, together with an air conditioning system, for heating ventilation and air conditioning (HVAC) systems in commercial buildings, and is also adaptable for use in indoor residential or commercial applications.

17 Claims, 4 Drawing Sheets

AIR HEATING APPARATUS

BACKGROUND OF THE INVENTION

This present invention relates generally to devices for heating air. More specifically, the invention discloses an apparatus for heating air in a space heating system. The apparatus of the invention is particularly suitable for use in heating, ventilation and air conditioning (HVAC) systems for commercial buildings, but is adaptable for use in residential applications.

HVAC systems for commercial buildings such as stores, manufacturing facilities, low rise office buildings and similar structures typically contain "package" units which combine air conditioning, heating and sometimes air handling equipment in a single housing. Such package units are generally installed outside the building envelope, frequently at ground level or on the building roof. A typical package unit comprises: an air conditioning compressor, associated condenser and evaporator coils and air conditioning system auxiliary components; a heating system comprised of some combination of heat source and heat exchange means such as electrical resistance heaters or gas or oil fired burners and associated heat exchangers; and a flow path for air to be cooled or heated to pass through the unit. Air from the building is circulated through the unit and returned to the building by means of a system of supply and return ductwork, with some means of causing a flow of air through the system. The air handling equipment for moving air through the system may be separate or included in the package unit. Architectural, engineering, economic and environmental considerations have driven efforts to reduce the size and weight of package units as well as other types of HVAC equipment, to improve the thermal efficiency of heating systems and, in the case of heating systems that produce heat by burning a fuel, to reduce the emission of potential pollutants.

A heat pipe is a heat transfer device capable of transferring heat from a higher to a lower temperature at a high rate. The principles of the construction and operation of heat pipes are well known in the art. Because of their high thermal conductance, heat pipes are well adapted to use in HVAC equipment for transferring heat from the heat source to the air to be heated and can result in significant reductions in space and weight reductions in HVAC heating components, for a given heat transfer rate, over other types of heat transfer devices such as conventional flue gas to air heat exchangers.

The usual means by which a gaseous or vaporized liquid fuel is burned in a space heating appliance is a ribbon type burner located under the heat exchanger or by what is known in the industry as an "inshot" or jet type burner whose flame is directed into the inlet of the heat exchanger. Natural convection or a blower to create a forced draft are generally used to cause the gases of combustion to flow through and out of the heat exchanger. In such a furnace, the burning process generates not only heat but low frequency sound termed "combustion roar." If the appliance is connected into an air ducting system, the ducting tends to amplify the sound and transmit it to spaces remote from the appliance.

The products of combustion from flame burners in space heating appliances now in widespread use contain oxides of nitrogen ($NO_x$). The oxides are vented to the atmosphere with the combustion products as flue gases. Limiting the concentration of $NO_x$ in the flue gases is desirable, as $NO_x$ can contribute to air pollution and appliances sold in certain jurisdictions must comply with very low $NO_x$ emission requirements.

The use of a radiant infrared burner in a heating device instead of the more usual flame burner has certain advantages, chief among them as pertain to this invention are that the gases of combustion produced by a radiant burner have very low concentrations of $NO_x$ and that the radiant burner burns silently, without producing combustion roar.

A conventional gas or oil fired space heating device, such as is now in widespread use, operates at a relatively low thermal efficiency, converting typically only 65 to 70 percent of the available heat energy in the fuel burned to heat available to warm the space it serves. Much of the efficiency loss is due to the heat contained in the hot gases of combustion produced by the burner that pass "up the flue" and are lost to the atmosphere. The efficiency of such a space heating appliance can be significantly improved by condensing certain of the gases of combustion produced thus extracting the latent heat of condensation from those gases before they escape "up the flue."

SUMMARY OF THE INVENTION

It is an object, therefore, of the present invention to attain reductions in the size and weight of a space heating apparatus without decreasing the heat output of the apparatus.

It is another object of the invention to attain high thermal efficiency in a space heating apparatus through the extraction of the latent heat of condensation from the gases of combustion produced in the apparatus and by using high performance heat pipes for the transfer of heat within the apparatus.

It is a further object of the invention to attain reductions in the levels of oxides of nitrogen in the flue gases discharged from a space heating apparatus.

It is a still further object of the invention to achieve the above objects in a space heating apparatus that has a minimum number of moving parts and that is simple, rugged and adaptable to use in a number of different applications.

These and other objects of the invention are achieved by providing a space heating apparatus in which a plurality of heat pipes are disposed with an enclosure such that the evaporating section of each heat pipe is disposed within a combustion chamber and the condensing section of each heat pipe is disposed within an air heating chamber. A radiant burner is disposed within the combustion chamber. Heat is transferred to the heat pipe evaporating sections by direct radiation from the radiant burner and from the hot gases of combustion produced by the burner. The heat pipes transfer the heat from their evaporating sections to their condensing sections, where the heat is transferred to and warms the air passing through the air heating chamber.

In a preferred embodiment of the invention, combustible gas, comprising a mixture of gaseous fuel and air, is caused to flow to and through the radiant burner and gases of combustion produced by the burner when it burns the combustible gas are caused to flow out of the combustion chamber by induced draft.

The apparatus taught by the invention is capable of producing the same heat output as conventional space heating devices four to five times it size and produces low levels of $NO_x$ emissions in its gases of combustion. It is particularly suited for use in large capacity package HVAC units but is readily adaptable to other applications such as smaller wall mounted package units and to residential and commercial warm air furnaces located within a building envelope.

Although preferred embodiments of the present invention are illustrated and described, other embodiments may occur to those skilled in the art. It is therefore intended that the invention be limited only by the scope of the below claims.

BRIEF DESCRIPTION OF THE DRAWINGS

The accompanying drawings form a part of the specification. Throughout the various drawings, like reference numbers designate like or corresponding parts or features.

DESCRIPTION OF THE PREFERRED EMBODIMENTS

Figure 1:
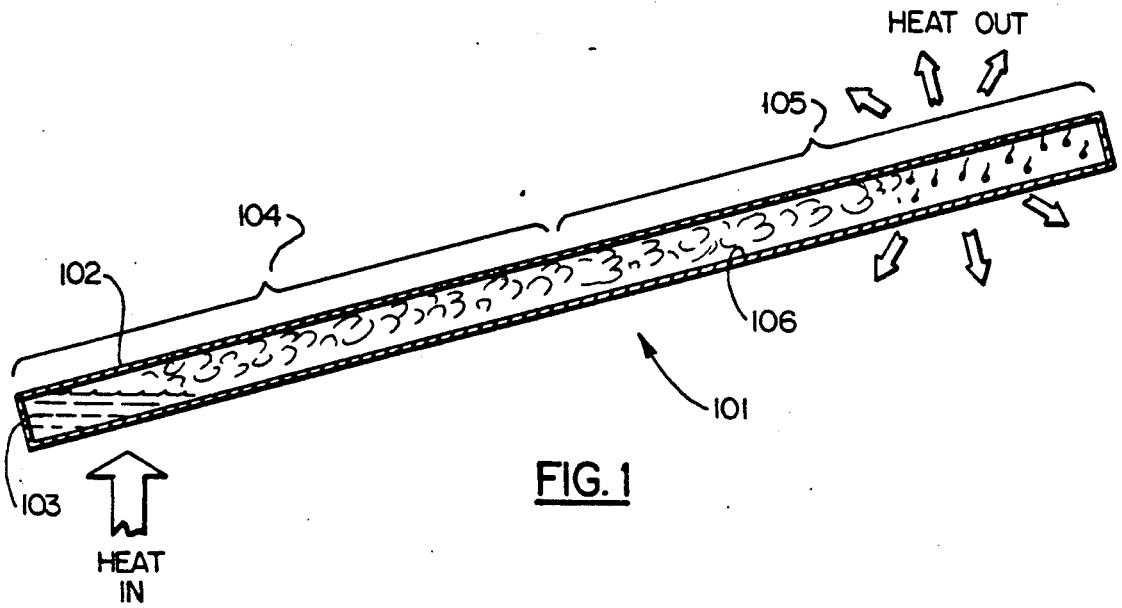
FIG. 1 depicts a schematic view of a typical heat pipe and illustrates the principle of operation of a heat pipe.

The construction and operation of a heat pipe is well known in the art but is described here in general terms to facilitate the description of the preferred embodiments that follow. FIG. 1 shows a schematic view of a typical heat pipe 101. Heat pipe 101 is a hollow tubular member sealed at both ends, having wall 102 and containing heat transfer fluid 103. Heat pipe 101 may be generally divided into evaporating section 104 and condensing section 105. In a given heat pipe, the pipe material and the heat transfer fluid may be selected from a variety of substances depending on the heat transfer characteristics and operating temperatures, the surrounding environment and the application to which the heat pipe will be put. To function as a heat transfer device, evaporating section 104 is located in a region of relatively higher temperature and condensing section 105 is located in a region of relatively lower temperature. In operation, heat transfer fluid 103 in a liquid state located in evaporating section 104 absorbs heat through wall 102 from the higher temperature region surrounding evaporating section 104 and changes state to a vapor. Heat transfer fluid 103 in vapor form migrates to condensing section 105, where it gives up heat through wall 102 to the lower temperature region surrounding condensing section 105 and changes state back to a liquid. By means of the wicking action of wick 106, heat transfer fluid 103 in liquid form returns to evaporating section 105 to begin another heat transfer cycle.

Alternatively, if condensing section 105 is higher in elevation than evaporating section 104, heat transfer fluid 103 in liquid form will flow from condensing section 105 to evaporating section 104 by gravity, obviating the need for wick 106.

Figure 2:
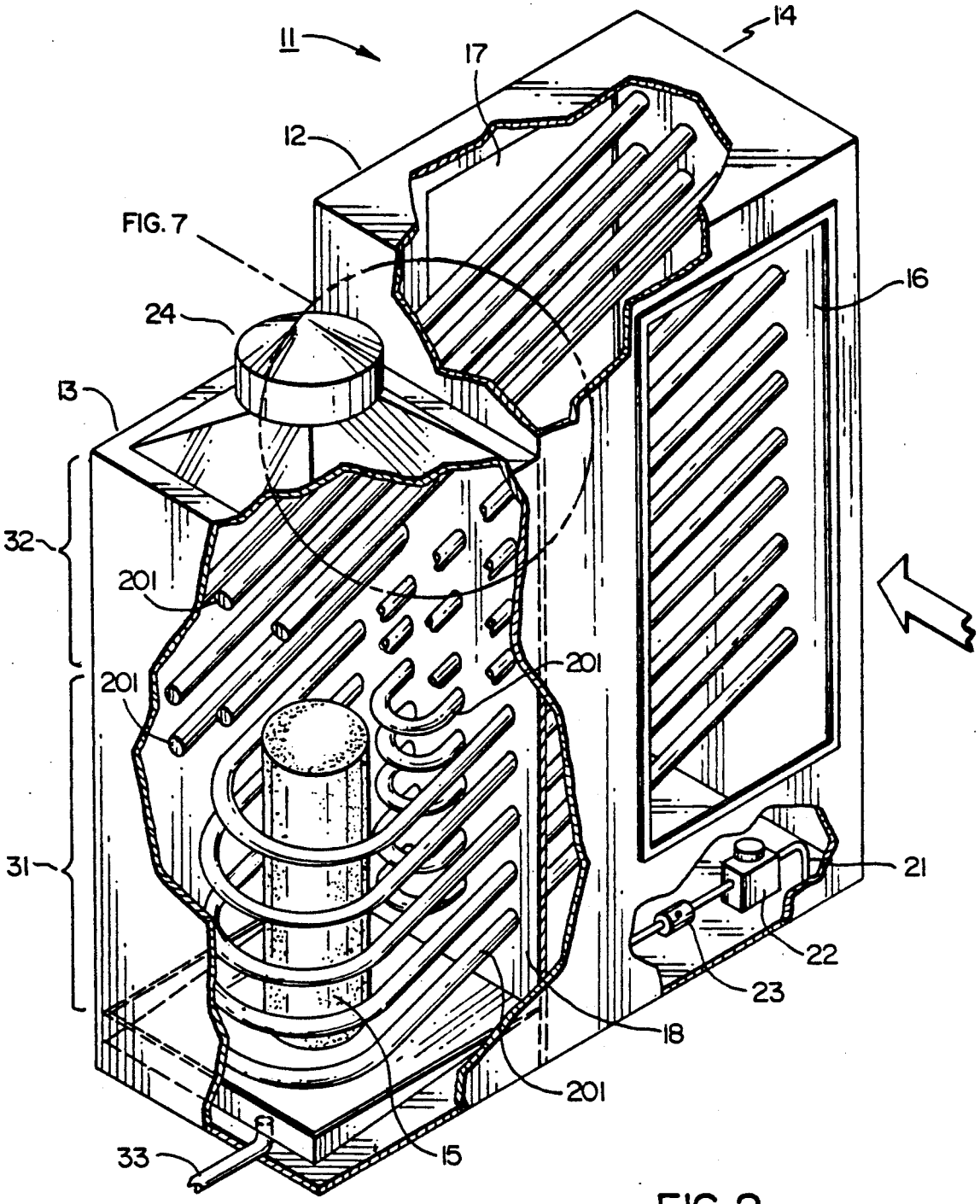
FIG. 2 depicts an isometric view, partially broken away, of a space heating apparatus constructed in accordance with one embodiment of the present invention.

Turning now to FIG. 2, that figure depicts, in an isometric view, partly broken away, a space heating apparatus constructed according to one embodiment of the invention. Air heating apparatus 11 comprises enclosure assembly 12 in which are located combustion chamber 13 and air heating chamber 14. Centrally disposed in combustion chamber 13 is radiant burner 15. Air inlet 16 and air outlet 17 allow air to be heated to pass through air heating chamber 14, channeled and urged by external ducting and air handling means (not shown). Separating combustion chamber 13 from air heating chamber 14 is gas impervious wall 18.

The apparatus is supplied with gaseous fuel through fuel supply line 21 and regulating valve 22. Air for combustion is drawn through air inlet port 23 where it mixes with the gaseous fuel to form the combustible gas burned in radiant burner 15. Induction draft unit 24 causes a flow of combustible gas to and through radiant burner 15 and a flow of flue gas produced by radiant burner 15 through and out of combustion chamber 13 to be exhausted to the atmosphere. Combustion chamber 13 is otherwise closed to the passage of air so that when the apparatus is in operation, the only air entering combustion chamber 15 is that which is mixed with gaseous fuel and hence there is no secondary combustion on radiant burner 15. Apparatus 11 is fitted with ignition, control and safety devices (not shown). These devices are conventional ancillary components that start up and shut down the apparatus in response to HVAC system heating requirements, ignite radiant burner 15 on start up, provide necessary safety functions and require no further description here.

Disposed within combustion chamber 13 and extending into air heating chamber 14 are a plurality of heat pipes 201. FIGS. 2*a* through 2*e* depict various heat pipe configurations that may be used in air heating apparatus 11. Heat pipes 201*a* through 201*e* (FIGS. 2*a* through 2*e* respectively) each comprise evaporating sections 204 and condensing sections 205. Each heat pipe 201 (FIG. 2) is disposed within apparatus 11 so that its evaporating section 204 is within combustion chamber 13 and its condensing section 205 is within air heating chamber 14. The shape of a given heat pipe 201 is either generally U-shaped (as heat pipe 201*a*, FIG. 2*a*) or straight (as heat pipe 201*b*, FIG. 2*b*). The location of a given heat pipe within combustion chamber 13 determines its shape. Generally U-shaped heat pipes are used in that portion of combustion chamber 13 into which radiant burner 15 extends, both to provide physical clearance for the burner and to allow for maximum exposure of the heat pipe's external surface to direct radiation from the burner. In the portion of combustion chamber 13 above radiant burner 15, straight heat pipes may be used.

Figures 2A, 2B, 2C, 2D, 2E:
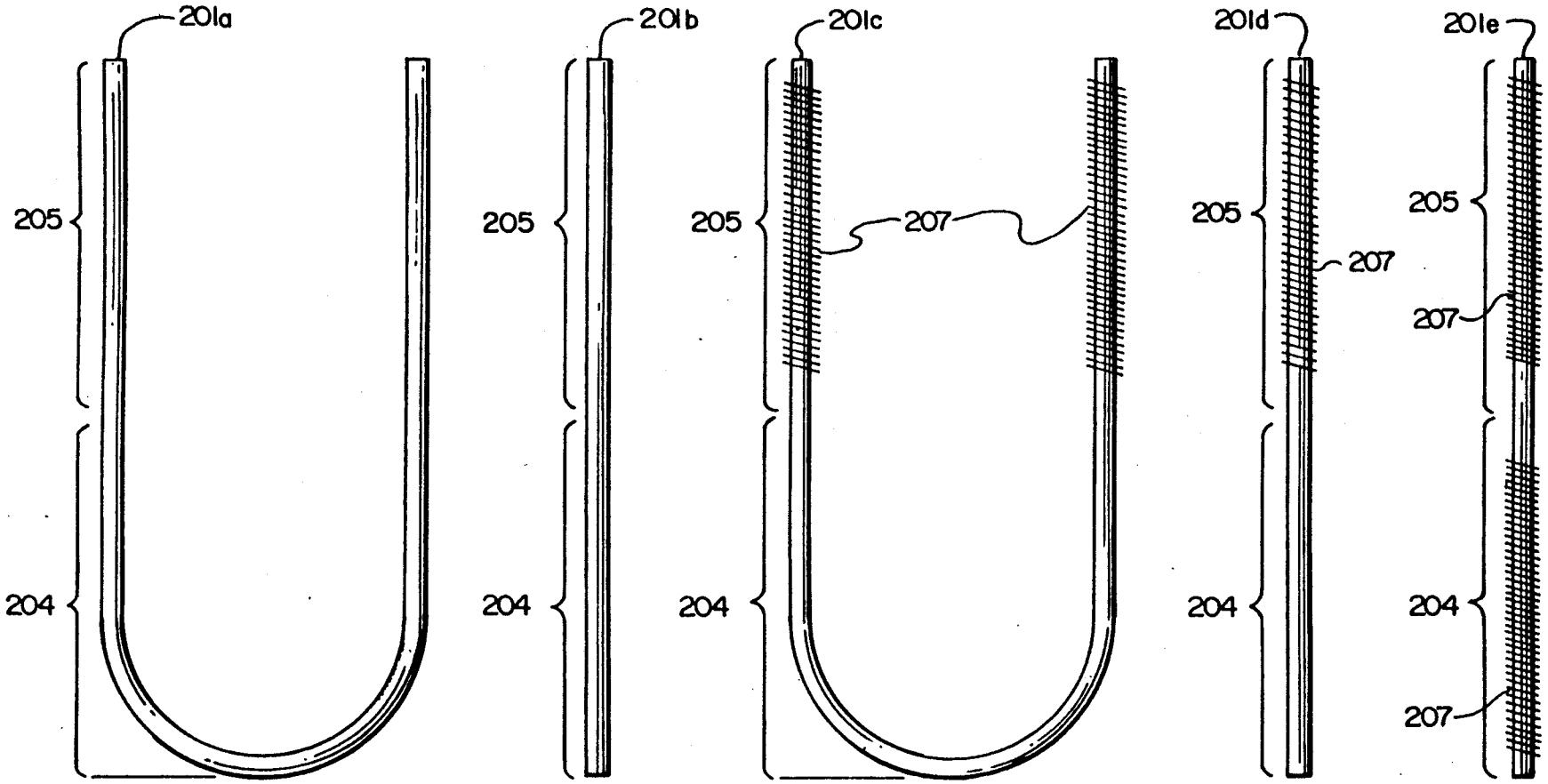
FIGS. 2*a* through 2*e* depict plan views of heat pipes used in various embodiments of the invention.

Combustion chamber 13 can be divided into direct radiation section 31 and flue gas condensing section 32. Direct radiation section 31 is that portion of combustion chamber 13 in which the evaporating sections of heat pipes 201 are in direct "view" of radiant burner 15 and receive heat from radiant burner 15 primarily by radiation. Flue gas condensing section 32 is that portion of combustion chamber 13 in which the evaporating sections of heat pipes 201 are not in direct "view" of radiant burner 15 and receive heat by conduction from the flue gases produced by radiant burner 15. The various configurations of heat pipes 201 may be externally finned to improve conductive heat transfer, both in absorbing heat in combustion chamber 13 and giving off heat in air heating chamber 14. Since the mode of transferring heat to the air to be heated in air heating chamber 14 is conduction, if externally finned heat pipes are used, the portions of all heat pipes 201 that are within air heating chamber 14 should be finned. Similarly, those portions of heat pipes 201 that are within flue gas condensing section 32 of combustion chamber 31 should be finned. However, those portions of heat pipes 201 that are within direct radiation section 31 should not be finned, as external fins can inhibit radiant heat transfer from the radiant burner to the heat pipes by shielding portions of the external surfaces of the heat pipes from exposure to direct radiation from the burner. FIGS. 2*c* through 2*e* therefore illustrate preferred external fin configurations for heat pipes 201 if external fins are used. Each of heat pipes 201*c*, 201*d* and 201*e* (FIGS. 2*c*, 2*d* and 2*e* respectively) have external fins 207 over their condensing sections 205. Generally U-shaped heat pipe 201*c* and straight heat pipe 201*d* do not have fins over their evaporating sections 204, but straight heat pipe 201e does have external fins 207 over its evaporating section 204. Thus if heat pipes 201 (FIG. 2) are finned, those heat pipes 201 having evaporating sections 204 located in direct radiation section 31 would be configured like heat pipe 201*c* or 201*d*, depending on their position with respect to radiant burner 15, while those heat pipes 201 having evaporating sections 204 located in flue gas condensing section 32 would be configured like heat pipe 201*e*.

In flue gas condensing section 32, the flue gas produced by radiant burner 15 is cooled to a temperature at which several of the constituents of the flue gas give up their latent heat of condensation and condense. The resulting condensate is removed from combustion chamber 13 via condensate drain 33.

The embodiment of the invention depicted in FIG. 2 and described above is adapted for use as a single purpose heating apparatus for providing space heating for a building where the apparatus is located outside the building envelope (e.g. on its roof or at ground level outside the building) and connected to the building by suitable ducting and with external air handling equipment used to move air through the air heating chamber. The invention is adaptable to other applications as well.

Figure 3:
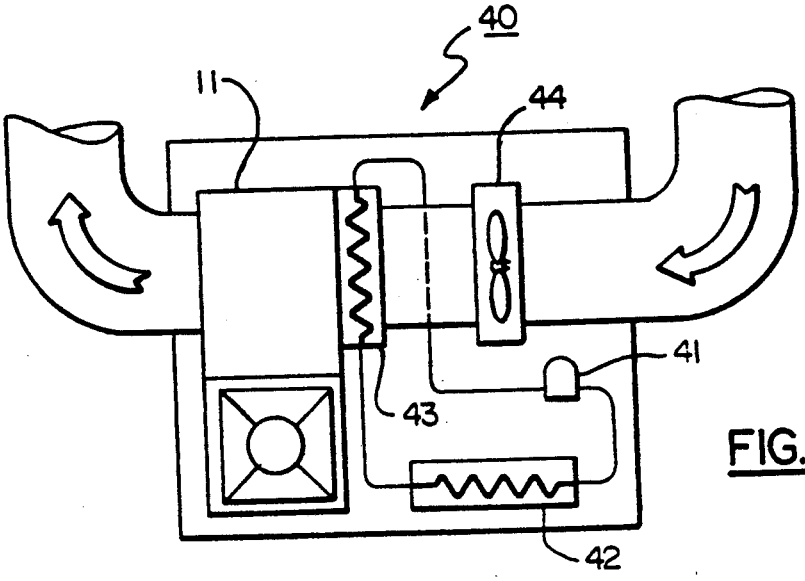
FIGS. 3 through 6 are schematic representations of other embodiments of the invention.

FIG. 3 depicts an embodiment of the invention employed in a complete package HVAC unit able to provide not only space heating but also cooling and air handling. In FIG. 3, packaged HVAC unit 50, in addition to air heating apparatus 11, also comprises air conditioning compressor 51, condenser 52, and evaporator 53, connected by suitable interconnections, as well as air handler 54.

Figure 4:
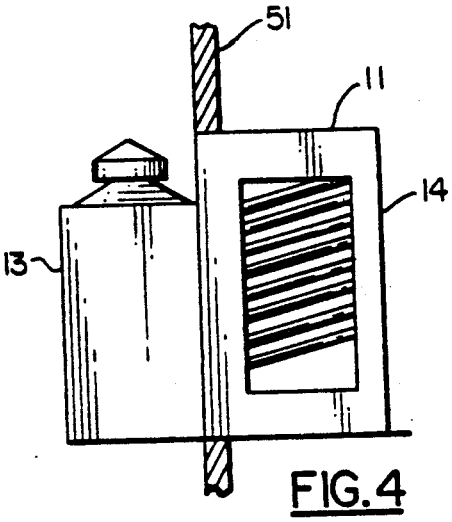
Figure 5:
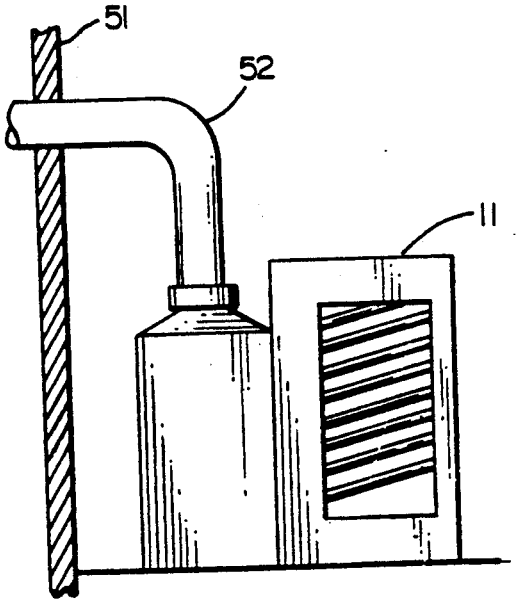

In the two embodiments described above, the combustion chamber of the apparatus is located outdoors so that flue gas can be vented directly to the atmosphere, without requiring flue ducting from the apparatus to an outside vent. FIGS. 4 and 5 depicts still other embodiments of the invention. In FIG. 4, air heating appliance 11 is depicted as a "through-the-wall" space heater, with appliance 11 extending through building wall 51 and having combustion chamber 13 outside and air heating chamber 14 inside the building envelope. The embodiment shown in FIG. 4 requires no flue ducting.

In FIG. 5, apparatus 11 is depicted in an embodiment in which it is located entirely within the building envelope. In this embodiment, an external flue duct 52 would be required. Both the embodiment depicted in FIG. 4 and the embodiment depicted in FIG. 5 could be further made into complete space heating systems by the addition of suitable ducting, air handling and, if complete HVAC systems are desired, cooling equipment.

Figure 6:
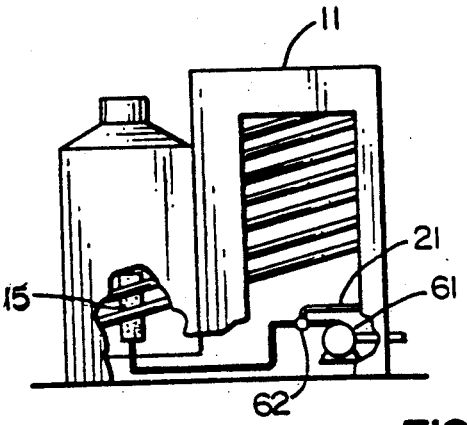

The embodiment of the invention depicted in FIG. 2 employs induction means to cause a flow of combustible gas into and through its radiant burner and a flow of flue gas produced by the burner out of the combustion chamber. The invention is also adaptable to use with a forced draft system. FIG. 6 depicts such an embodiment, in which combustible gas flows to and through radiant burner 15 because of the pressure developed by forced air blower 61. Air discharged from forced air blower 61 is mixed with fuel gas from supply line 21 at air mixing valve 62 to form the combustible gas supplied to radiant burner 15.

Figure 7:
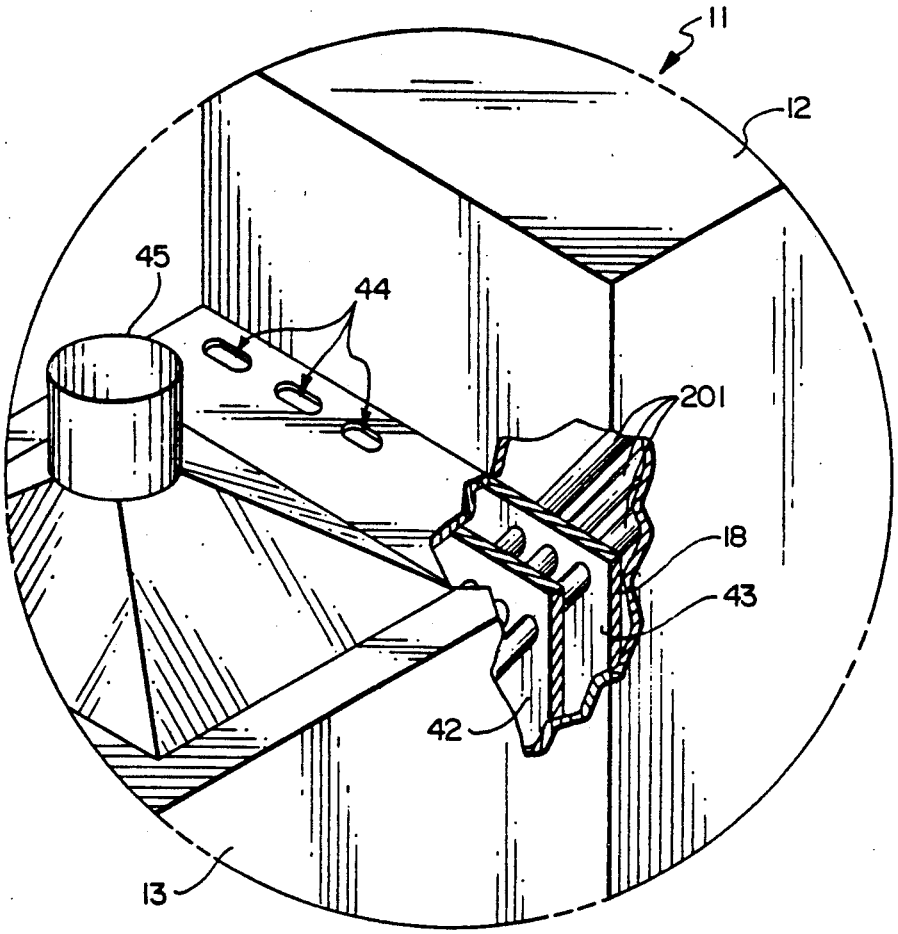
FIG. 7 is a isometric detail view of a portion of the apparatus depicted in FIG. 2 showing a recommended modification to the apparatus when the embodiment of the invention shown in FIG. 6 is used.

Referring again to FIG. 2, if forced draft is employed with the invention, the pressure in combustion chamber 13 will be at a pressure greater than atmospheric. In that case, should there be an opening in separating wall 18 due, for example, to a manufacturing defect or deterioration of the wall in service, flue gas could leak from combustion chamber 13 into air heating chamber 14 and thence to the spaces being heated by appliance 11. Therefore, if forced draft is employed with the invention, enclosure assembly 12 of apparatus 11 should be modified as shown in the detail of the enclosure assembly shown in FIG. 7, in which a second gas impervious wall 42 parallel to wall 18 is provided between combustion chamber 13 and air heating chamber 14, to form interwall space 43. In addition, the air handling equipment associated with apparatus 11 should be configured so as to provide a pressure no less than atmospheric in air heating chamber 14. A vent or vents 44 are provided at the top of interwall space 43 to allow any flue gas that leaks from combustion chamber 13 to flow out of apparatus 11 before the gas can leak into air heating chamber 14.

Copper is a suitable material for use in fabricating the heat pipe tubes used in the invention. Either copper or aluminum is suitable for fabricating the external pipe fins. Because of the potentially corrosive nature of the flue gas condensate, those portions of the heat pipes and fins that are exposed to the condensate should be covered with a suitable corrosion resistant coating such as a heat resistant epoxy resin material. At the operating temperatures of the apparatus, water is a suitable heat transfer fluid for use in the heat pipes. A suitable antifreeze, such as ethylene glycol or methylene glycol, should be added to the water used in the heat pipes to prevent damage to the apparatus when it is idle during extreme cold conditions.

FIG. 2 depicts heat pipes 201 installed in air heating apparatus 11 at an angle to the horizontal. An angle of about 15° is suitable. In this configuration, wicks internal to heat pipes 201 are not required, for the reason explained in the discussion associated with FIG. 1. If internal wicks are included in heat pipes 201, the heat pipes may be installed horizontally in apparatus 11.

What is claimed is:

1. An apparatus for heating air comprising:

an enclosure assembly;

a combustion chamber disposed within said enclosure assembly;

an air heating chamber having an air inlet and an air outlet disposed within said enclosure assembly;

a radiant burner disposed within said combustion chamber;

means for supplying a combustible gas to said radiant burner;

means for causing a flow of said combustible gas through said radiant burner and for causing a flow of gases of combustion produced by said radiant burner out of said combustion chamber; and a plurality of heat pipes, each having an evaporating section, a condensing section and containing a heat transfer fluid, each of said evaporating sections being disposed within said combustion chamber so as to receive heat from said radiant burner and each of said condensing sections being disposed within said air heating chamber so as to transfer heat to air flowing from said air inlet to said air outlet.

2. The apparatus of claim 1 in which said flow causing means comprises an induction fan.

3. The apparatus of claim 1 in which said flow causing means comprises a forced air blower.

4. The apparatus of claim 3 in which said enclosure assembly further comprises a vented interwall space, formed by a first gas impervious wall and a second gas impervious wall, separating said combustion chamber from said air heating chamber.

5. The apparatus of claim 1 in which said heat transfer fluid is a solution of water and ethylene glycol.

6. The apparatus of claim 1 in which said heat transfer fluid is a solution of water and methylene glycol.

7. The apparatus of claim 1 in which said heat pipes incline generally upward from said combustion chamber to said air heating chamber such that said condenser section of each said heat pipe is at a greater elevation than said evaporator section of each said heat pipe.

8. The apparatus of claim 7 in which said heat pipes incline upward at an angle of about 15° from the horizontal.

9. The apparatus of claim 1 in which said combustion chamber further comprises a direct radiation section and a flue gas condensing section, that portion of each of said heat pipes that is within said flue gas condensing section has heat transfer enhancing fins and that portion of each of said heat pipes that is within said air heating chamber has heat transfer enhancing fins.

10. The apparatus of claim 1 in which, where necessary, said evaporating sections of said heat pipes are generally curved to provide clearance for said radiant burner and to provide for maximum exposure to direct radiation emitted by said burner.

11. The apparatus of claim 10 in which said generally curved evaporating sections are generally U-shaped.

12. The apparatus of claim 1 further comprising means for causing a flow of air from said air inlet to said air outlet.

13. The apparatus of claim 1 in which said enclosure assembly is adapted for installation external to a building.

14. The apparatus of claim 1 in which said enclosure assembly is adapted for mounting through the wall of a building such that said combustion chamber is located exterior to said building and said air heating chamber is located within the interior of said building.

15. The apparatus of claim 1 in which said enclosure assembly is adapted for installation entirely within the interior of a building.

16. Equipment for conditioning the air in a space comprising at least an apparatus for air cooling and an apparatus for air heating contained within a single enclosure in which said apparatus for air heating comprises:

a combustion chamber and an air heating chamber;

a radiant burner disposed within said combustion chamber;

means for supplying a combustible gas to said radiant burner;

means for causing a flow of said combustible gas through said radiant burner and for causing a flow of gases of combustion produced by said radiant burner out of said combustion chamber; and a plurality of heat pipes, each having an evaporating section, a condensing section and containing a heat transfer fluid, each of said evaporating sections disposed within said combustion chamber so as to receive heat from said radiant burner and each of said condensing sections disposed within said air heating chamber so as to transfer heat to air.

17. A method of heating air comprising:

in an apparatus having a combustion chamber, a radiant burner disposed within said combustion chamber, an air heating chamber and a plurality of heat pipes, each having an evaporating section and a condensing section and containing a heat transfer fluid, disposed within said apparatus such that said evaporating sections are disposed within said combustion chamber and said condensing sections are disposed within said air heating chamber, transferring heat produced by said radiant burner to said heat transfer fluid in said evaporating sections, transferring heat by means of said heat transfer fluid from said evaporating sections to said condensing sections, and transferring heat from said condensing sections to air flowing through said air heating chamber.

* * * * *